US006783382B2

(12) United States Patent
Felps

(10) Patent No.: US 6,783,382 B2
(45) Date of Patent: Aug. 31, 2004

(54) PUSH-LOCK PRECISION BNC CONNECTOR

(75) Inventor: Jimmie D Felps, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/284,226

(22) Filed: Oct. 29, 2002

(65) Prior Publication Data

US 2004/0082213 A1 Apr. 29, 2004

(51) Int. Cl.[7] ..... H01R 13/62; H01R 13/213; H01R 4/50

(52) U.S. Cl. ..... 439/314; 439/332

(58) Field of Search ..... 439/310–315, 439/317–319, 332, 335

(56) References Cited

U.S. PATENT DOCUMENTS 5,695,365 A * 12/1997 Kennedy et al. ..... 439/638
6,095,841 A * 8/2000 Felps ..... 439/312
6,561,841 B2 * 5/2003 Norwood et al. ..... 439/489

* cited by examiner

*Primary Examiner*—Michael C. Zarroli
(74) *Attorney, Agent, or Firm*—Edward L. Miller

(57) ABSTRACT

A housing carries a male push-lock precision BNC connector. The function of the BNC latch of the male connector carried therein is performed by a spring-biased lock ring captive in a housing and that fits snugly and concentrically over a male sleeve, resulting in a double shell of two rigidly attached cylindrical portions that are coaxial, coextensive, yet separated to accept a BNC female shell. The double shell is held captive by anchoring it to the inside of the housing. The male sleeve has a slot and/or cut-away portion to accept the forward travel of the bayonet pins, which, when the connector halves are engaging, extend beyond the thickness of the sleeve and into the region occupied by the lock ring. The lock ring has grooves having various portions that engage the bayonet pins. As the housing containing these male parts is without rotation moved toward the female connector, the lock ring rotates as the grooves contact the bayonet pins. After sufficient angular rotation the grooves allow the two connector halves to approach each other without further rotation of the lock ring. After the male and female halves are essentially fully mated along the axial direction, the grooves clear the bayonet pins, and a bias spring rotates the lock ring, whose grooves now present a path at right angles to the axial path. The lock ring now blocks the separation of the connector halves. To create the tension needed to draw the precision BNC connector parts firmly together, the grooves resume a shallow angled path (ramp). The bias spring continues to provide the force to rotate the lock ring. Eventually the bayonet pins resist any further motion of the lock ring. The lock ring has a thumb tab that extends out from the housing to allow the motion of the lock ring to be reversed when removing the push-lock connector.

5 Claims, 7 Drawing Sheets

PUSH-LOCK PRECISION BNC CONNECTOR

REFERENCE TO RELATED APPLICATIONS

The subject matter of this disclosure is related to, and makes use of, that which is disclosed in U.S. Pat. No. 6,095,841 entitled PUSH-LOCK BNC CONNECTOR, filed 20 Mar. 1998 by Jimmie D. Felps, issued 1 Aug. 2000, and assigned to Agilent Technologies of Palo Alto, Calif. Because of the similarity in subject matter, and for the sake of brevity in the present case, the U.S. Pat. No. 6,095,841 is hereby expressly incorporated herein by reference, and will be referred to either as "PUSH-LOCK BNC CONNECTOR" or as "the incorporated '841 patent" or perhaps merely as ". . . '841" where the context excludes any ambiguity. For the same general reasons, the pending US Application Ser. No. 10/136,120 entitled PRECISION BNC CONNECTOR, filed 30 Apr. 2002 by James E. Cannon and assigned to Agilent Technologies of Palo Alto, Calif., is also hereby expressly incorporated herein by reference, and will be referred to as "PRECISION BNC CONNECTOR".

BACKGROUND OF THE INVENTION

The present invention concerns the confluence of two issues related to high frequency test equipment, and particular, to test equipment where individual coaxial connectors are used to connect a detachable probe to that equipment. One example is present day high performance oscilloscopes.

The first issue concerns what series connector is used, especially for probes or the connections to signals to be measured by the test equipment, and that are not merely an ancillary part of a test set-up. It is customary for 'scopes to employ BNC connectors for their front and rear panel connections. The BNC connector has a number of attractive features that, so far anyway, have outweighed its disadvantages. These attractive features include ease of use (a quarter twist to mate or un-mate), small enough to not consume too much panel space but not so small as to be mechanically delicate, reasonable in cost and already widely in use with many manufacturers and mounting styles to choose from. It is also a controlled impedance connector, and is available in the commonly used values of 50 Ω and 75 Ω. Save for characteristic impedance, any BNC connector will (in theory, anyway) mate with one of the opposite gender, regardless of who the manufacturers were or what the mounting styles are. In many respects it is the workhorse of the general electronics industry; if it wasn't at hand we'd have to invent it. Nevertheless, and despite its longevity and venerable origin [the Bayonet Navy Connector (BNC) was developed for the US Navy during WW II] it has begun to reveal certain shortcomings. The following several paragraphs relating to the shortcomings of the conventional BNC connector, and an attractive solution therefor, have been abstracted from PRECISION BNC CONNECTOR.

Despite its popularity, the BNC connector has some significant drawbacks when used as an instrument grade connector for some electronic test equipment, such as top of the line high frequency oscilloscopes. It has reactive discontinuities at high frequencies. That is, above certain frequencies it fails to match the 50 Ω characteristic impedance of the coaxial transmission line of which it is expected to be a part. Even the most carefully installed silver-plated mil-spec clamp type BNC connector is extremely visible as a discontinuity on a TDR (Time Domain Reflectometer) of even modest bandwidth. Next, it tends to "leak" (radiate from its mating surfaces) above, say, 500 MHZ. Finally, since it relies solely on internally supplied spring tension to draw its parts together, it can, when under externally applied tension, allow the mating parts to separate sufficiently to degrade the quality of the connection (greater discontinuity, more loss), sometimes to point where the connection is interrupted altogether (especially if the parts are worn from extended use).

Many of the problems of BNC connectors can be traced to aspects in the design of the male half, which is to say, the part that has the male center conductor pin and that is given the quarter turn twist while gripping a knurled shell we shall call a bayonet latch. Let us briefly take a closer look at the conventional BNC connector, the better to appreciate why it has these problems.

The female connector portion includes a female center pin that is centered and held in place by an enclosing Teflon female sleeve. The female sleeve has a reduced diameter portion in front, and toward the rear has a stepped diameter that engages a corresponding shoulder in a female shell. The female sleeve is secured in place from the rear in various ways, depending upon the style and manufacturer. The reduced diameter portion in front will be of interest, shortly.

Now consider the male connector half. As an assembly, it includes a Teflon male sleeve whose rear portion has a small diameter bore that centers and supports a male center pin, and whose front portion has a larger diameter bore sized to just slip over the reduced diameter portion of the female sleeve. When the connector halves are properly mated the two Teflon sleeves are not only in contact over adjacent cylindrical surfaces, but the female sleeve "bottoms out" inside the male sleeve. (The terms "male" and "female" are applied to component parts according to the connector halves as a whole, and its gender is determined by the shape of the center conductor pin. Viewed in isolation, the "male" Teflon sleeve might be thought to be "female", as it surrounds the outside of the "female" sleeve when the connector halves are mated. But it is part of the male connector half. So it is that the male sleeve has a female shape, but is still called the male sleeve.) Potential gender confusion aside, the important thing is that when proper mating occurs there are edges and surfaces of the sleeves that "vanish" to form one (i.e., unitary) longer tube of Teflon that will be the dielectric material disposed between the center conductor and the outer shield forming the coaxial transmission line.

A similar thing happens to the center pins that they carry. The male pin has a reduced diameter tapered tip that enters a cavity, or socket, centered in the end of the female center conductor. The cavity is slightly undersize, but the end of the female socket is slit to allow a slight resilient outward motion that promotes good ohmic contact between the pins. The thus-expanded outer diameter of the female center pin is the same as that of the male center pin, so that when they are fully mated a shoulder on the male pin and the face of the female pin "disappear" as each of the two pins presses against the end of the other, and the pins appear to be one (unitary) longer cylindrical conductor.

The two sleeves and the two pins are supposed to fully mate simultaneously, for if one were to mate before the other it would prevent the further motion needed by the other to become fully mated.

Surrounding and carrying the sleeves are respective cylindrical connector shells, one male and one female. The male shell has a collection of slits so that they can bend inward slightly under compression as they enter a female shell of slightly insufficient diameter. This provides good ohmic contact for maintaining the outer shield of the coaxial system. Once again, the male shell is expected to bottom out against a stepped diameter within the female shell, so that (save for the slits) the mated pair of shells appears as a complete unitary cylinder of uniform inner diameter as the end of the male shell vanishes against the shoulder inside the female shell.

A pair of bayonet pins on the outside of the female shell engage detents at the end of a quarter turn spiral groove in a rotatable captive bayonet latch carried on the male shell. Depending upon the particular design, a spring located somewhere in the above described elements provides a resilient force that pulls the center pins, sleeves and shells together once the detents in the bayonet latch contain the bayonet pins. If everything is working correctly, no RF currents flow through the connection between the bayonet pins and the bayonet latch. Unfortunately, pulling on the cable, or otherwise inducing external tension urging the two connector halves apart, can overcome the internal spring tension keeping the connectors halves together. If a sufficient tension is applied the connector halves will draw apart slightly.

There are two basic aspects that we wish to point out. First, the tapered end of the male center pin enters a slitted socket in the end of female pin, and ordinarily spreads those slit portions apart slightly, for good contact. As the connector wears the diameter of the tapered end portion of the male center pin and the resilience in the slit female pin are both reduced, while the inner diameter of the female pin is increased, so that a slight withdrawal of the male pin can significantly decrease the ohmic quality of the connection. Equally as bad at higher frequencies, as the withdrawal occurs, there appears a short length over which there is a marked decrease in center pin diameter. That is, the male and female center pins have the same outer diameter, and when they are fully mated there are annular surfaces that touch, shoulder to shoulder. When that occurs there is no, or very little, effective change in the outer diameter of the combined center pins. When these shoulders do not touch there is an immediate reduction in diameter to that of the tapering end of the male pin. A similar increase in the effective diameter of the outer conductor occurs also, as the end of the male shell pulls away from the shoulder in the female shell that it seats upon. These changes are important, since the characteristic impedance of a coaxial transmission line involves the ratio of the outer diameter of the center conductor and the inner diameter of the outer conductor, as moderated by the dielectric constant therebetween. When the male center pin withdraws slightly from the female pin, the short length of diameter reduction occurs at about one quarter of an inch from the location where the short length of outer diameter increase occurs, and this "double whammy" appears as a very definite discontinuity.

A similar bad thing happens in connection with the Teflon sleeves. Ordinarily, the reduced diameter section of the female sleeve would be the exact complement of the large diameter portion of the male sleeve. The idea is that when they mate their edges vanish, as it were, and the two parts act as a single part of continuously present material of the proper diameter. That fails when the connector halves pull apart, producing another discontinuity owing to a location of altered dielectric constant. This happens adjacent where the center pins have their "diameter fault," increasing the resulting discontinuity. Furthermore, the presence of the Teflon is a bit of a problem in the first place, since it is difficult to machine the stuff to the tolerances needed to reliably perform the magic of the vanishing edges. Also, it is the Teflon that is supposed to hold the center conductor pins in their proper locations. Not only is Teflon difficult to machine to tight tolerances, but it won't hold them over time, even if it could be done, since Teflon cold flows so easily. Even a brand new connector, but especially a used connector, will have Teflon sleeves that exhibit and account for significant mating anomalies at frequencies above, say, 500 MHZ. This is no longer a minor matter.

Here now is a brief summary of how the improved BNC connector described in PRECISION BNC CONNECTOR solves these problems. Here is the Summary Of The Invention from that Disclosure:

> "A solution to the problem of poor RF performance in the conventional BNC connector is to first, eliminate the use of Teflon, in favor of an air dielectric in the vicinity of the mating parts, and support the male and female center pins further back within the body of the connector, using other proven dielectric materials borrowed from the precision type N connector, or from another 7 mm RF connector. Next, a captive knurled draw nut provides positive displacement and the tension needed to draw the already mated male and female connector halves together, in place of the conventional spring tension. It is the bottoming out of the male shell inside the female shell that resists the positive displacement and the tension supplied by the knurled draw nut, ensuring that the two connector halves are actually in contact, and that the edges of surfaces that need to "vanish" for good operation do indeed vanish. The mating center conductors are rigidly mounted within their shells and bottom out against each other at the same time as do the shells. The basic bayonet latch mechanism is retained, so that either half of the new connector will mate with opposite sex halves of conventional BNC connectors."

Today, many oscilloscopes operate at ten times the frequency at which conventional BNC connectors begin to exhibit degraded performance, and some operate considerably higher. There is, in fact, a large installed base of such oscilloscopes that use a conventional BNC connector. These high frequency 'scopes use active probes that perform, among other things, impedance conversion, so that the signal can be supplied to the 'scope over an intervening 50 Ω transmission line, which is the cable that connects the probe to the 'scope. We are now faced with a situation where the connector of choice is a principal limitation in the overall performance of the 'scope/probe combination. It is true that there are other RF connectors that would solve the problem of the rotten RF connection, but they are unsuitable for one or more reasons. Some are simply too expensive, and, it will be noted, the expensive ones tend to be threaded and/or easily damaged; APC 3.5 connectors come to mind in this regard. Precision type N connectors would carry the signals all right, but they, too, are threaded, and besides being moderately expensive, they take a lot of panel space. The old GR-874 "sexless" and "push-on" connectors even comes to mind. It was (and still is!) a pretty good connector, perhaps when in good condition, even comparable to precision type N. But it is as big or bigger than N, is more expensive, and sadly, seems to be on the verge of "going away." Well, then, so be it. It would seem that we should switch to the precision BNC connector. (We note that it cooperates, with some degradation in performance, conventional BNC. That helps lessen the sting of a change to a new style.) We can easily arrange to use the precision female portion on the front panel, since it is essentially a direct replacement. Alas, even if we do, there is yet another fly in the ointment.

The second issue concerns the electrical attachment of 'scope probes in particular. In the oldest (and by today's standard, largest) passive probes, adjustable compensation was located in the probe body and the cable at the 'scope end had just a boot protecting a cable mounted male connector. Front panels were big, bandwidth was low, and this was thought to be a tidy solution. Later, for smaller passive probes of higher bandwidth the compensation components were located in a small box at the 'scope end of the cable, and a bulkhead mount male connector attached the box to the female bulkhead connector on the (smaller) front panel of the 'scope. Today's very high bandwidth active probe is smaller still, and for some brands the 'scope end of the cable has a pod or housing the size of a small farm-rat (or at least a large house mouse) that contains a "push-lock" BNC connector, and also provides mounting for a modest number (six to nine) of other single conductor auxiliary connections between the pod and the front panel. There are many reasons to have this housing in the first place, and good ones for having it abut the front panel of the 'scope. Probe identification, probe settings, probe power (and possibly, but not necessarily, power return) are all conveyed by these additional connectors (which are essentially spring loaded pins). The push-lock feature arises from the need to do something to cause the quarter-turn twist that the bayonet locking mechanism requires on the one hand, and the desire to not require rotation of the housing, lest that cause mischief from temporary mis-connection between the pins and their corresponding pads on the front panel. Add to that the circumstance that there is (as a practical matter) no room to get a user's thumb and forefinger in there to rotate the BNC latch. For one thing, the face of the pod or housing should be up against the scope front panel to assist in making the auxiliary connections, while for another, it is sometimes the case that adjacent BNC jacks are located so close together on the panel that, even if there were no rat-sized bulge in the way (and perhaps no auxiliary conductors), it would still be a real aggravation to get that thumb and forefinger in there to twist the BNC latch.

The push-lock BNC connector described in the incorporated '841 Patent solves this issue nicely. One merely holds the pod or housing in the hand, and while the connector halves are axially aligned, pushes the housing toward the 'scope. The assembly in the housing that corresponds to the BNC latch twists, but not the pod (which may even have alignment tabs to prevent it). Eventually the detents of the twisting latch align with the bayonet pins of the female connector half on the front panel, and spring bias rotates the latch by an amount sufficient to achieve engaged detents, or "lock" (which is less than the usual quarter turn). To release the male connector/pod the user presses against and rotates a tab or lever with his thumb or a fingertip. The tab is a portion of the BNC latch mechanism that extends out from the pod or housing for just that purpose. Once the latch is rotated to clear the detent, the user simply pulls back on the housing to separate it from the front panel. Unfortunately, despite its ease of use in attaching and detaching it from the 'scopes front panel, it is still a conventional BNC connector as far as the quality of the transmission line segment formed by the connector is concerned. It significantly limits the performance of the 'scope when higher frequencies are considered.

It will be clear that what we ought to do is put a male precision BNC connector into the housing, with the intent of having it work in a manner similar to the way the push-lock technique presently does. But upon reflection we realize that, once the detents in the BNC latch engage the bayonet pins, the precision BNC connector utilizes a knurled draw nut that engages threads on the male side and then draws the two connector shells tightly together by retracting the male BNC latch against the female's bayonet pins, thus forcing the shells and center pins into complete contact. (Another way to state it is that tightening the draw nut forces the male shell and pin forward into their female counterparts, and after they simultaneously bottom out, continued displacement pulls the BNC latch away from the bayonet pins. That provides the static force that keeps things tight.) To have to additionally turn (and un-turn!) that knurled draw nut seems like a form of retrograde progress, compared to the ease of use presently associated with the conventional push-lock connector technique described in the incorporated '841 Patent. But it has the potential for 18 GHz performance when both sides are precision BNC, and it even still mates with conventional BNC connectors on existing 'scopes (although with same reduction in the degree of increased performance, owing to the presence of Teflon, tolerances, etc.). This is just too good to pass up. There has to be a way . . . the question is: "How to do it?"

SUMMARY OF THE INVENTION

A housing carries a male push-lock precision BNC connector. The function of the BNC latch of the male connector carried therein is performed by two cooperating parts: The first is a spring-biased lock ring captive in a housing and that fits snugly and concentrically over a male sleeve. The second is the male sleeve. There are different embodiments, but in one an end of the male sleeve is pressed over a back portion of a BNC male shell, resulting in two rigidly attached cylindrical portions that are coaxial, coextensive, and separated by a slight gap wide enough and deep enough to accept a BNC female shell during connector mating. For convenience, we call this subassembly a double shell. The double shell is held captive, against any motion, by anchoring it to the inside of the housing. Thus the inside cylindrical portion of the double shell functions as the BNC male shell required for BNC connections. The outer cylindrical portion (the male sleeve) has a slot and/or cut-away portion to accept the forward travel of the bayonet pins, which, when the connector halves are engaging, extend beyond the thickness of the sleeve and into the region occupied by the lock ring. The lock ring has grooves having an angled portion that engage the bayonet pins of a female BNC connector. As the housing containing these male parts is held without rotation and moved toward the female connector, the lock ring rotates as the grooves contact the bayonet pins (which don't move, either). After sufficient angular rotation the angled portion of the grooves (as seen by the bayonet pins) bend to run parallel to the axis of the center pins, allowing the two connector halves to approach each other without further rotation of the lock ring. After the male and female halves are essentially fully mated along the axial direction, the axial portions of the grooves clear the bayonet pins, and a bias spring rotates the lock ring, whose grooves now present a path at right angles to the axial path. Rotation of the lock ring now blocks the separation of the connector halves, by interfering with where the bayonet pins would attempt to travel if the connector halves were pulled apart. Such pulling apart forces the front of the lock ring against a surface on the inside of the housing, where that motion is resisted. The result is that the BNC latch is captive on the bayonet pins.

To this point we have described the push-lock mechanism, equivalent to what is set out in the incorporated '841 patent. To create the tension needed to draw the precision BNC connector parts firmly together, the grooves resume their angled path after a brief length for the right-angled region. The new angle is shallow, and will be called a ramp portion.

The bias spring continues to provide force to rotate the lock ring, and eventually the bayonet pins resist any further motion of the lock ring. The lock ring has a thumb tab that extends out from the housing to allow the motion of the lock ring to be reversed when removing the push-lock connector. During installation the operator may, if desired, use his thumb or a finger to push the other way on the tab to assist the bias spring and further wedge the shallow ramp of the grooves tightly under the bayonet pins, where in any case, they stay until released by the normal release operation just described. The ramp portion is shallow enough (say 12.5°), and the bias spring force sufficient, to reliably wedge the bayonet pins until so released. Wiggling the housing actually allows the bias spring to increase the wedging action. The resulting force between the bayonet pins and the grooves in the lock ring performs the same function as the knurled draw nut in a stand-alone precision BNC connector.

In principle, the male sleeve may have only slots to accept the travel of the bayonet pins. In that case, however the amount of penetration of the bayonet pins into the grooves of the lock ring is diminished by the thickness of the sleeve, and may not be enough to assure reliable operation. The slots can be widened into cut-out regions proximate where the grooves in the lock ring are, and then the lock ring simply made thicker in those places, so that it descends into where the sleeve is now cut away, as it were. This allows the grooves to be deeper and contact the bayonet pins as effectively-as a conventional male bayonet latch does. There are yet other variations on how the sleeve is effected, some described in the incorporated '841 patent.

It will further be appreciated that the lock ring described for a precision BNC male connector, when used in an otherwise conventional push-lock connector having standard BNC male parts and mated to a conventional female BNC connector (as in an older 'scope that is part of an installed base) will also exhibit improved performance, owing to the BNC shells being drawn together and minimizing the "normal" discontinuities. And, of course, a new push-lock precision BNC (male) housing would also mate with an older female BNC connector, again with partially improved performance.

DESCRIPTION OF THE PREFERRED EMBODIMENTS

Figure 1:
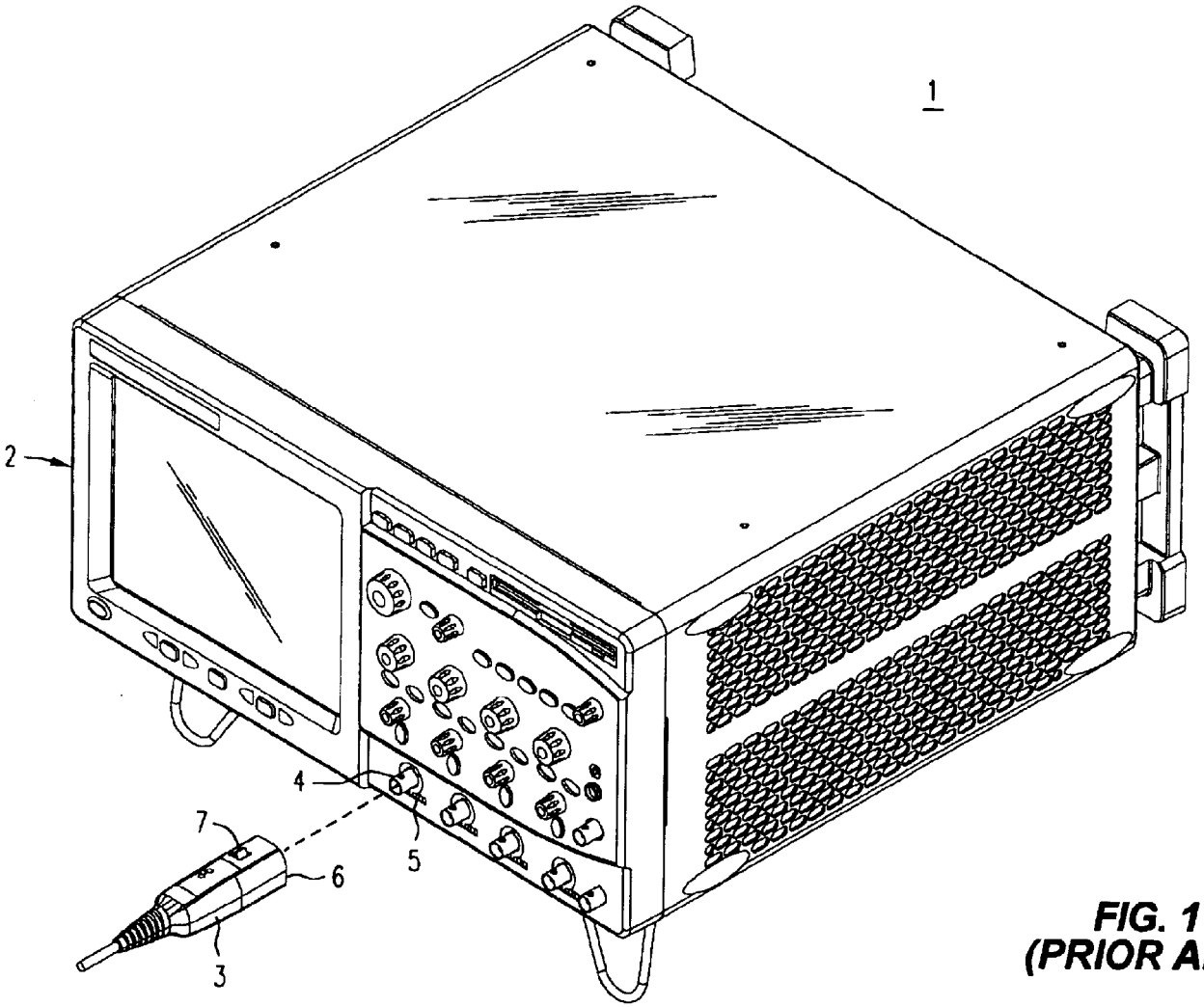
FIG. 1 (PRIOR ART)
FIG. 1 is a front perspective view of an oscilloscope using a prior art push-lock BNC connector mechanism for an electronic portion of an active probe.

Refer now to FIG. 1, wherein is shown a front perspective view 1 of a prior art electronic instrument 2, such as a digital oscilloscope, having one or more front panel connectors 4 that receive a push-lock BNC connector 3, say, in support of operation with active probes. In a manner explained in the incorporated '841 patent, the push-lock BNC probe housing is installed simply by lining it up and then pushing it toward the 'scope. When the push-lock connector 3 is in place, not only is a BNC connection established to connector 4, but a row of spring loaded pins 6 (not visible) on the front of the housing for the push-lock assembly engages a row 5 of contacts beneath the connector 4. To remove the push-lock connector the operator pushes on lever or tab 7 with a thumb or a finger, while pulling the assembly away from the 'scope.

Figure 2:
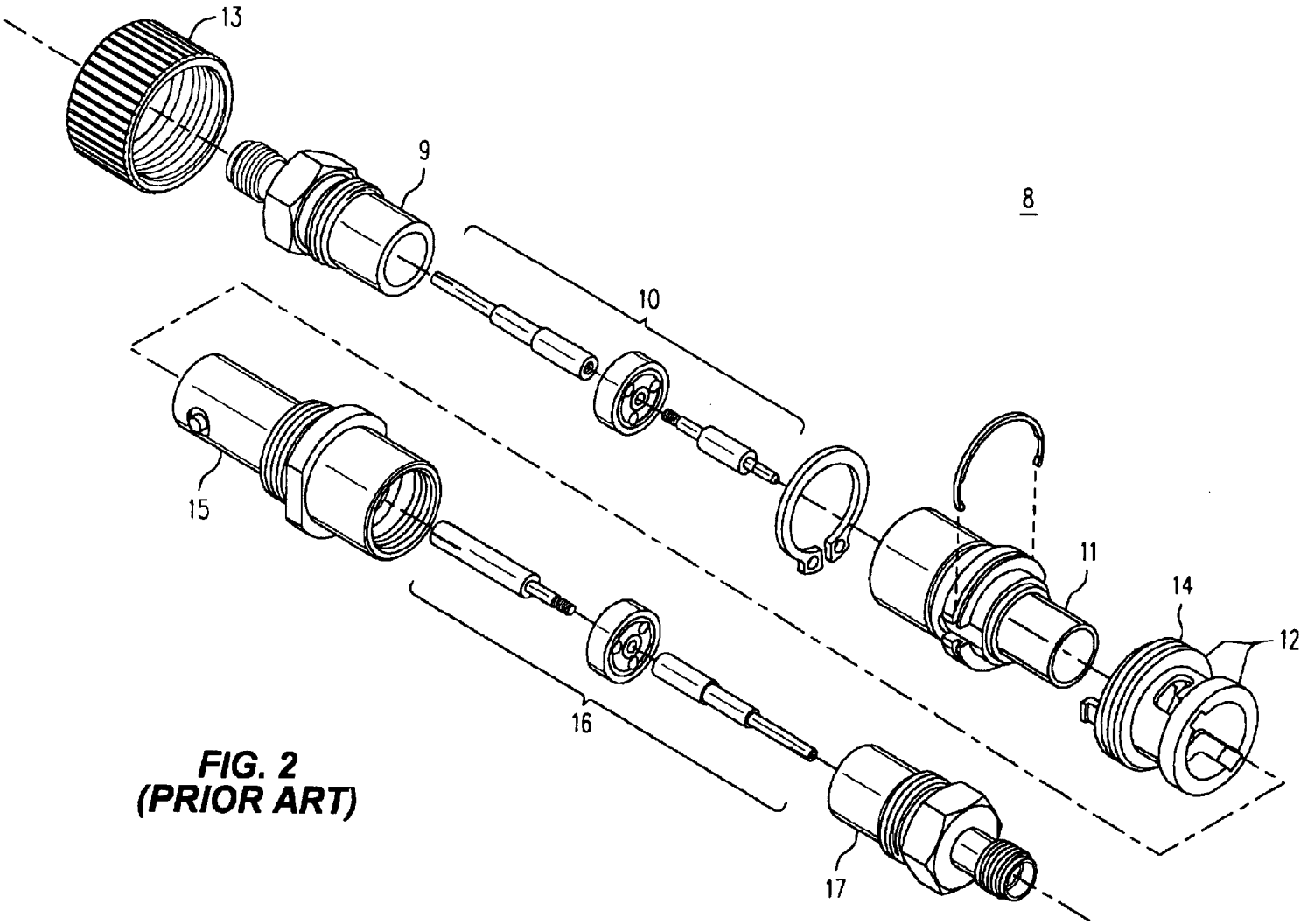
FIG. 2 (PRIOR ART)
FIG. 2 is an exploded perspective view of a prior art precision BNC connector.

Refer now to FIG. 2, which is an exploded perspective view 8 of a prior art precision BNC connector, as described in the incorporated application entitled Precision BNC Connector. The salient features of that connector that are of interest to us are these. The BNC male shell 11 has a solid cylinder with which to engage the female BNC shell 15. In both shells 11 and 15 there is an absence of Teflon. A male connector pin assembly 10 is assembled around a dielectric disc that is held against a shoulder in shell 11 by a threaded member 9. A female connector pin assembly 16 is similarly held in shell 15 by a threaded member 17. A BNC male latch 12 is captively affixed onto the male shell 11, and includes external threads 14. Threads 14 are engaged by the internal threads on a knurled draw nut 13, which is also captive to the male BNC shell 11. Knurled draw nut 13 is captive in a manner that allows it to rotate, but not to move along the axis of the connector. When the male shell and its latch 12 are mated with a female BNC connector, the draw nut 13 is rotated to cause the latch 12 to withdraw away from the female part and into the concavity of the draw nut. This action does not proceed very far until the latch is as far as it can go, being prevented by the bayonet pins on the female connector half from traveling further. At that point further rotation of the draw nut pushes the male shell 11 toward the female shell 15. That action proceeds until they are fully mated, and there is no further slack. At that point the center pins have just fully engaged, as have the two shells, and the mating surfaces on those parts "vanish" as described in the Background.

Figure 3:
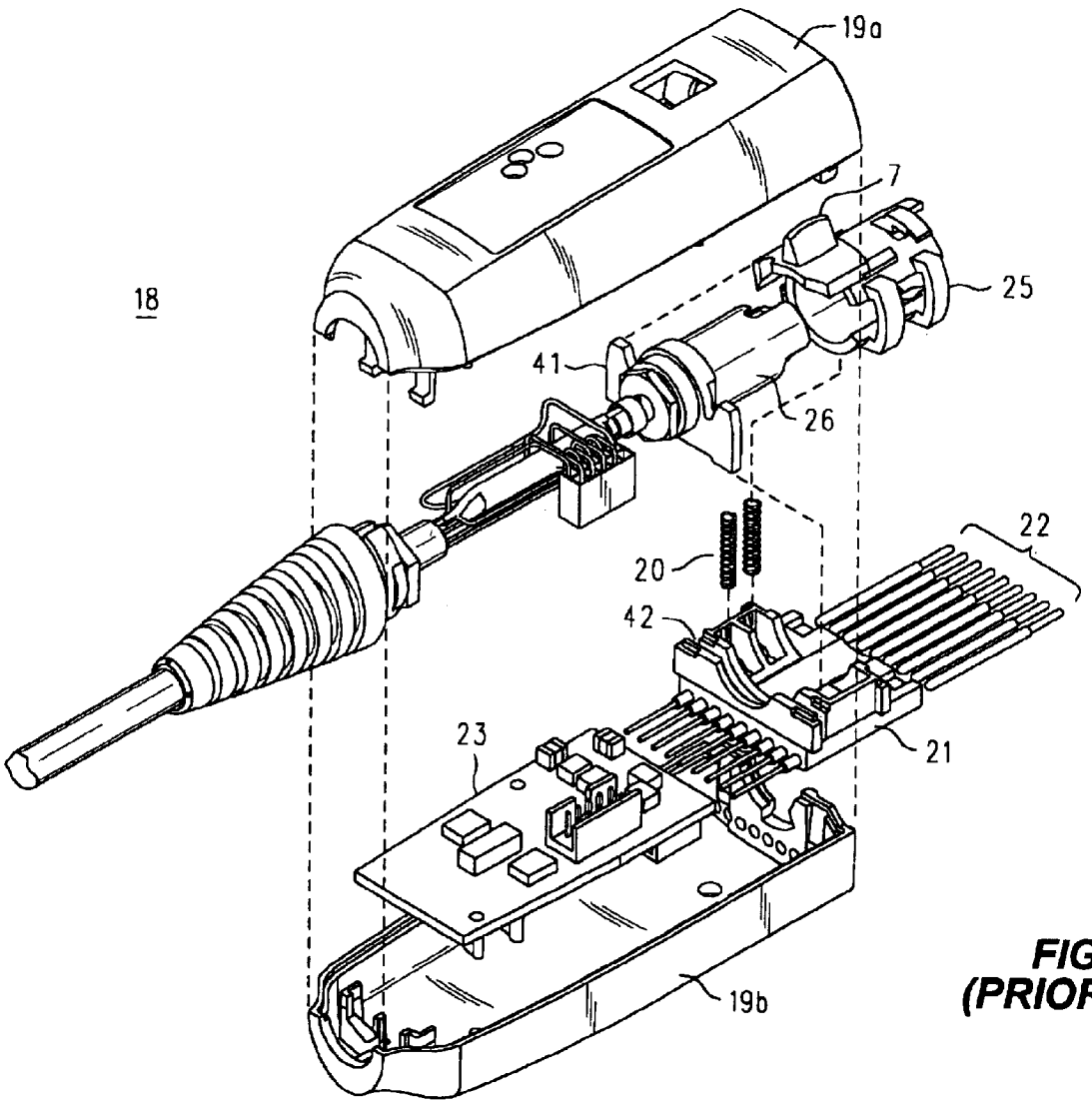
FIG. 3 (PRIOR ART)
FIG. 3 is an exploded perspective view of the prior art push-lock BNC connector of FIG. 1.

Refer now to FIG. 3, which is an exploded perspective view 18 of the prior art active probe 3 of FIG. 1. Here now is a brief introductory description of how it functions as a push-lock BNC connector. The whole push-lock assembly fits into top and bottom housing halves 19*a* and 19*b*, respectively. Within the housing is a carrier 21 that holds the spring loaded pins 22 and a printed circuit board 23 that is in electrical contact with the pins 22. A BNC male double sleeve 26 with mounting wings or flange 41 is made captive to the carrier 21 by the flange resting in a slot 42 and the enclosing action of the top half 19*a* of the housing. Not only is the male double sleeve 26 made captive, but it essentially made immobile, also.

A locking ring 25 performs the function of the male BNC latch. Locking ring 25 fits over the BNC male double sleeve, and tab 7 extends upward through a hole in the top half 19*a* of the housing. A pair of springs 20 biases the locking ring 25 as far as it can rotate in the direction of engaging and locking the bayonet pins of a female BNC connector. That direction is clockwise when viewed from the rear, say at the wings 41, looking toward the tab 7. Briefly, when the push-lock connector is installed on a female part the female shell will enter an annular space (not visible yet) between an outer sleeve portion of the double sleeve and a male shell that it encloses. The lock ring will momentarily rotate counter-clockwise as a groove internal to the lock ring rides over the bayonet pins, until a detent is reached, whereupon the springs 20 will force the lock ring back clockwise to engage the detent and lock the male double sleeve onto the female connector.

Figure 4:
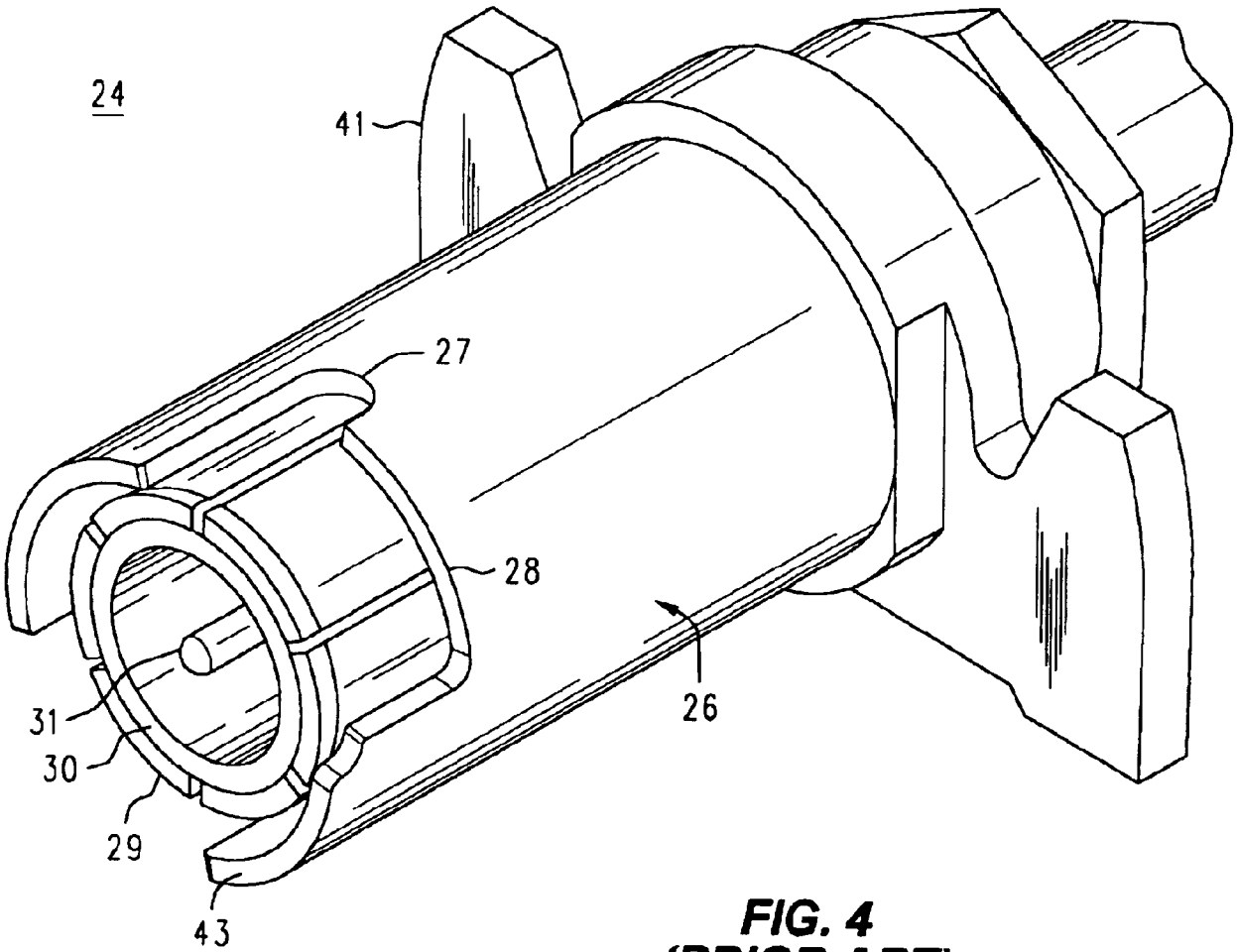
FIG. 4 (PRIOR ART)
FIG. 4 is a front perspective view of a prior art male BNC connector used in the prior art push-lock BNC connector of FIG. 3.

The process just described in connection with FIG. 3 will be further appreciated with reference to FIG. 4, which is a front perspective view 24 of the prior art male double shell 26 of FIG. 3. As can be seen in the figure, a male center pin 31 is surrounded by a Teflon sleeve 30, which in turn is surrounded by a slotted BNC male shell 29. Surrounding that is the annular space (for receiving the female shell), on the outer side of which is the sleeve portion 43 upon which the lock ring 25 revolves.

Items of interest are the bottom end of what would be a slot, except that cut-away region 28 has "enlarged" the slot on one side, so that it really isn't a slot any more . . . . The same thing happens on the diametrically opposite side of the double shell. Slot 27 (or what's left of it) is for receiving the bayonet pins of the female shell, and determines the angular position of the push-lock male connector relative to the female connector. It (27) could be a genuine slot if the outer sleeve portion 43 were really quite thin (not very practical) or if the bayonet pins were somewhat longer (which they are riot). The pins have to reliably engage the grooves in the lock ring 25, and since we can't bring the pins to the grooves, we bring the grooves to the pins by removing material from the sleeve at the affected location 28, and allowing the inner surface of the lock ring to extend into that region (28). That allows sufficiently deep grooves. This idea will be further illustrated when we get to FIGS. 6 and 7.

Figure 5:
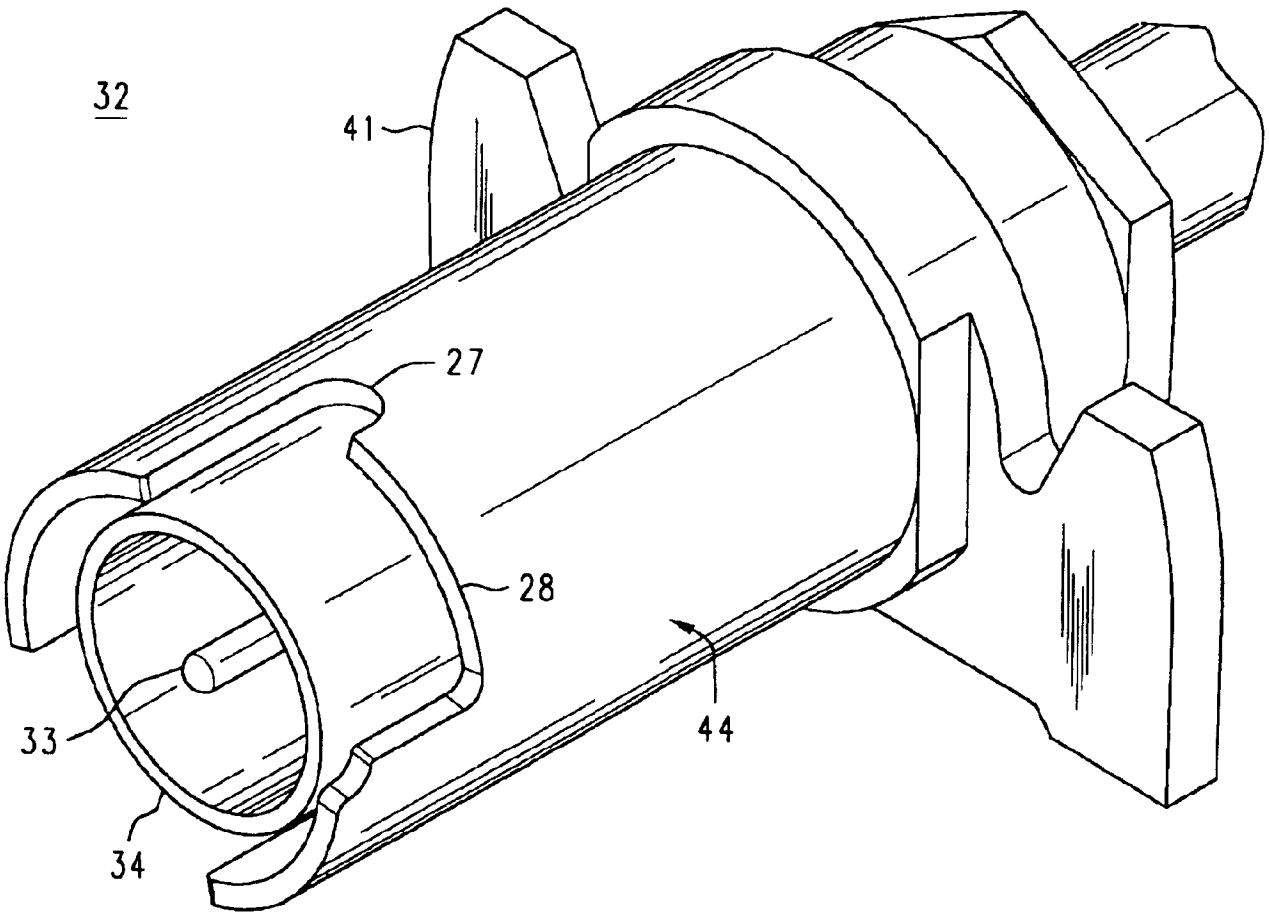
FIG. 5 is a front perspective view of a precision male BNC connector useable in an improvement to the push-lock BNC connector of FIG. 3.

Meanwhile, refer now to FIG. 5, which is a front perspective view 32 of an improved double shell 44 for use in precision BNC connector applications. Many of the aspects of this double shell 44 are similar to the double shell 26 of FIG. 4. These are the differences. First, in FIG. 5 there is no Teflon shell corresponding to shell 30 of FIG. 4, or any Teflon at all. Instead, double shell 44 is constructed in the same general manner as the male shell 11, male pin assembly 10 and threaded member 9 of FIG. 2. That is, the male pin 33 will be carried by a dielectric disc. Next, note that the male shell 34 itself is free of slots; it is a cylinder without slots or slits. Various other features that are the same, and have reference numbers that correspond to similar features in FIG. 4.

The male shell 34 is fabricated in this way to improve its performance. It does not need the slits of a conventional BNC male shell (and their thickened exteriors at the end), as it does not need to be forced to spring inward slightly upon mating in order to ensure good ohmic contact with the inside of the female shell. Instead, it will make excellent contact when it bottoms out under compression, at the same time the center pins become fully mated. The Teflon is gone for reasons set out in the Background, and an air dielectric is used, instead.

Figure 6A:
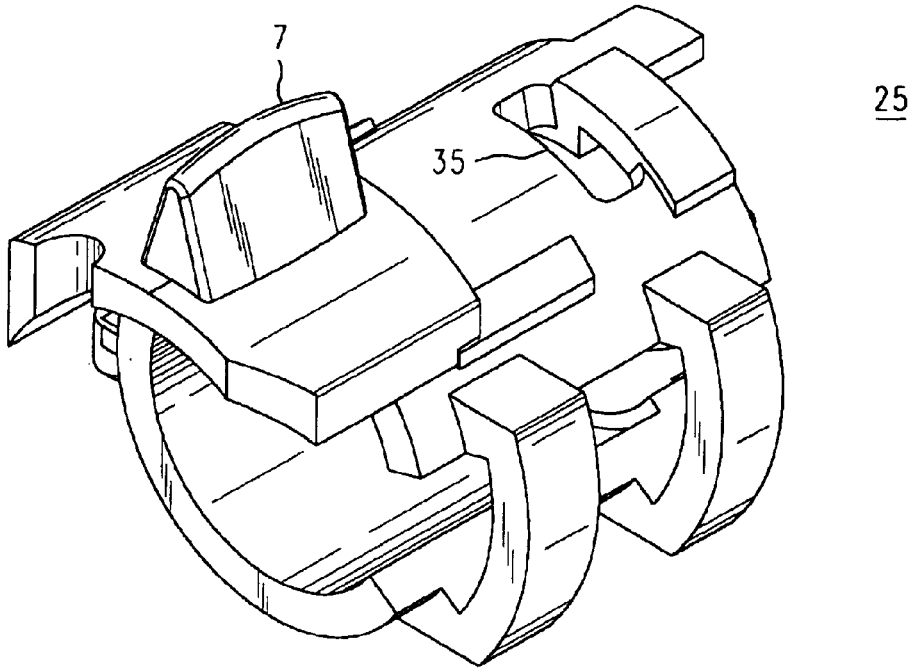
FIG. 6A (PRIOR ART)
FIGS. 6A are 6B are front and rear perspective views of a prior art lock ring used in the prior art push-lock BNC connector of FIG. 3.
Figure 6B:
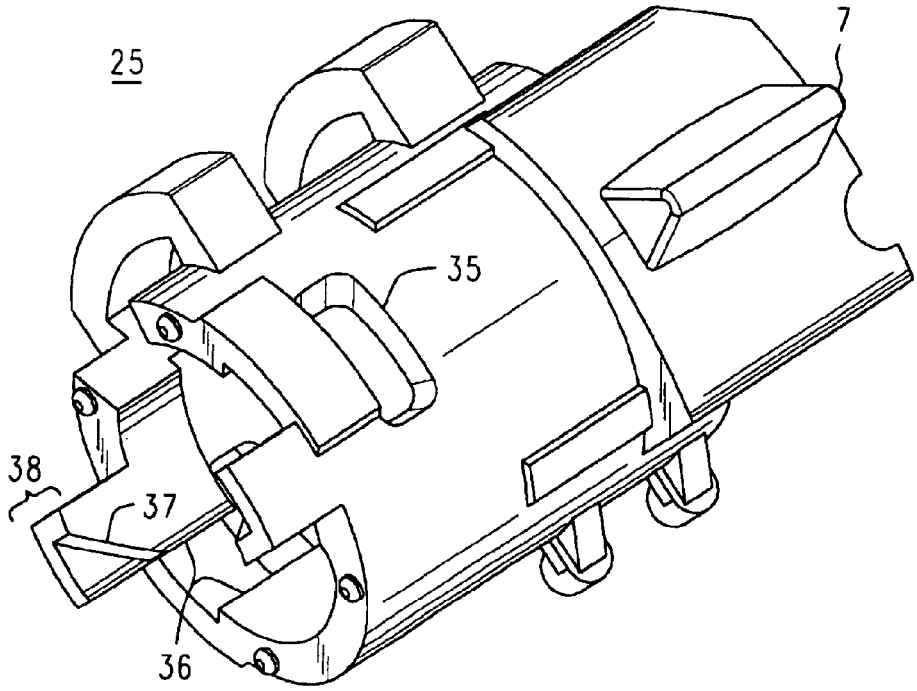
FIG. 6B (PRIOR ART)

Refer now to FIGS. 6A and 6B, which are front and rear perspective views of the prior art lock ring 25 of FIG. 3. What we have called a groove in the lock ring 25 starts out as a inclined surface, or "cocking" ramp 37, which leads to an axially aligned groove 36, ending in a detent groove 35. The increased thickness of the lock ring 25 that extends into region 28 of the double shell is indicated reference number 38.

Now, not only should we use the improved double shell 44 of FIG. 5, but we also need to provide a way to draw the double shell (either 26 or 44!) and the female BNC shell together. Note that as indicated, either a conventional or improved double shell might be at hand. We prefer the improved part (44), but some improvement in performance will occur even if the conventional double shell remains in use.

Figure 7A:
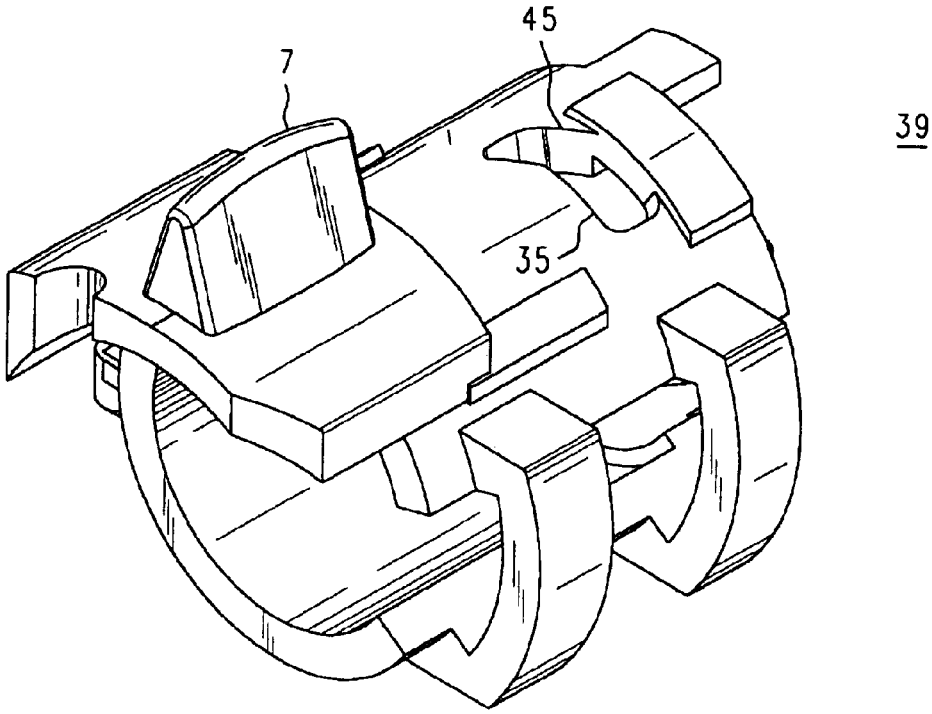
FIGS. 7A and 7B are front and rear perspective views of an improved lock ring useable with the precision male BNC connector of FIG. 5 and/or as an improvement in the push-lock BNC connector of FIG. 3.
Figure 7B:
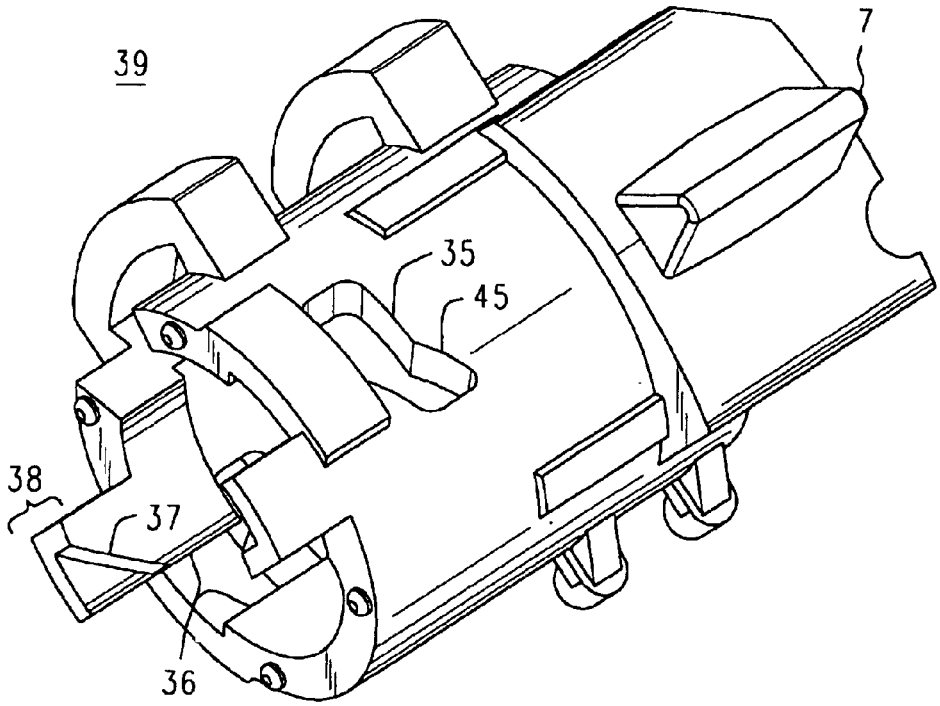

Refer now to FIGS. 7A and 7B, which are front and rear perspective views of an improved lock ring 39, some of whose reference numbers are the same as similar features on the prior art lock ring 25 of FIGS. 6A and 6B. Everything is pretty much the same, except that we have added to, or extended the grooves. Detent portion 35 of the groove still produces the conventional lock of the BNC male latch. It is extended, however, along locking ramp portion 45. Locking ramp portion 45 is inclined to portion 35 by about 12.5°. What the locking ramp portion 45 does is draw the male and female shells together by about 0.010" in about 40° of rotation. Should the force provided by the springs 20 not be sufficient to do this unaided, and the operator can assist by pressing on the tab 7 with his thumb, moving the tab in the direction opposite that used to detach the push-lock precision BNC connector.

Here is one difference of note. Refer now to FIG. 7B, and consider the view in the direction from inclined surface 37 toward tab 7. With the connector detached, the springs 20 will rotate the lock ring 39 fully counter clockwise (CCW). When the housing is held in position for attaching the connector, bayonet pins of the female connector (not shown) engage cocking ramps 37, and forward motion (down and to the left as seen in the figure) of the housing causes the lock ring 39 to rotate clockwise (CW). It will be appreciated that the amount of CW motion along ramp 37 is a cocking action, in that springs 20 are compressed by an amount that they will later extend when the bayonet pins enter detent and locking ramp portions 35 and 45. The point to note is that the springs cannot extend by an amount by which they are not first compressed. Thus, we are led to observe that the absolute amount of angular motion produced in lock ring 39 by the bayonet pins as they traverse the inclined surface of cocking ramps 37 must be at least that needed later when the bayonet pins are in the detent and lock ramp portions 35 and 45. Thus, the length of inclined surface 37 in FIG. 7B may need to be longer than the corresponding inclined surface of FIG. 6B.

It will be appreciated that various amounts of force, displacement, and angular tab motion are possible by adjusting the length and angle of inclination for the ramp portion 45.

Here is why the shells are drawn together. Recall that the wings or flange 41 are captive to the housing through slot 42. The lock ring 39 (and 25, too, for that matter) is also captive in the housing, such that it can rotate but not move back and forth along the direction of the center conductor. (We have not shown the features that make this occur, but it is done with symmetrical but complementary shapes for the lock ring and the part of the housing that encloses the lock ring. When ramp portion 45 encounters the bayonet pins, this draws the lock ring 39 toward the female shell. That pulls the housing 19*a*/*b* forward as well, which in turn pushes the double shell 44 toward the female shell. That, in turn, brings the center pins and the male and female shells into simultaneous and firmly biased contact. Ramp portion 45 should be long enough to ensure that the connectors are fully mated before the end of the ramp is reached. The springs 20 need to be strong enough to ensure that the bayonet pins remain wedged on the ramp 45. With adequate spring tension, any wiggling of the housing of the push-lock precision BNC connector will actually tighten the connection.

To remove the push-lock precision BNC connector the operator simply applies a modest pressure to the tab 7, similar to the unlocking motion of a conventional BNC connector.

It will be appreciated that there may be other connector styles with which the push-lock precision technique can used.

I claim:

1. A push-lock precision male connector for connection to a female connector along an axis of connection, the push-lock precision male connector comprising:

a hollow housing having an interior surface and a front outer surface having a first aperture therein that is generally centered on the axis of connection;

a cylindrical male shell captively mounted to the interior of the housing and having a male axis extending along the axis of connection, the male shell having an annular surface proximate the first aperture in the front outer surface of the housing;

a lock ring having a cylindrical bore therethrough, the bore disposed over and rotatable about the male shell, an exterior surface of the lock ring engaging the inner surface of the housing to be captive therein against linear motion along the axis of connection;

the housing having a second aperture proximate the location of the lock ring;

the lock ring having a tab extending outward and away from the axis of connection, and passing through the second aperture in the housing;

the lock ring having a groove in the surface of the bore, the groove engaging a pin on the exterior of the female connector, the groove having a cocking ramp portion that automatically rotates the lock ring through a first angular displacement as the push-lock precision male connector is pushed onto the female connector, the cocking ramp portion of the groove adjacent to a first end of a straight portion of the groove that lies in a plane also containing the axis of connection and that has a length therealong that is sufficient to essentially mate the push-lock precision male connector with the female connector, a second end of the straight portion of the groove adjacent to a first end of a detent portion of the groove at right angles to the straight portion and having a second angular displacement in a direction opposite that of the first angular displacement, a second end of the detent portion being adjacent to a locking ramp portion of the groove having a third angular displacement in a direction opposite to that of the first angular displacement, the first angular displacement being generally equal in amount to the sum of the second and third angular displacements, and the locking ramp inclined to pull on the pin and further draw the annular surface of the male shell into tight contact with a shoulder interior to the female connector; and a bias spring coupled between the interior of the housing and the lock ring, resiliently urging the lock ring to rotate in the direction of the second and third angular displacements and opposite the direction of the first angular displacement produced by the action of the pin on the cocking ramp portion of the groove during connector mating.

2. A push-lock precision male connector as in claim 1 wherein the male shell is a cylinder without slots therein.

3. A push-lock precision male connector as in claim 2 further comprising a male center pin assembly carried by a non-teflon dielectric disc.

4. A push-lock precision male connector as in claim 1 further comprising a male sleeve concentrically disposed over the male shell but interior to the bore in the lock ring.

5. A push-lock precision male connector as in claim 1 wherein the lock ring mates with a female BNC connector.

* * * * *

UNITED STATES PATENT AND TRADEMARK OFFICE

CERTIFICATE OF CORRECTION

PATENT NO. : 6,783,382 B2
DATED : August 31, 2004
INVENTOR(S) : Jimmie D. Felps

It is certified that error appears in the above-identified patent and that said Letters Patent is hereby corrected as shown below:

Column 6,
Line 16, before "reduction", delete "same" and insert therefor -- some --

Signed and Sealed this

Fourth Day of January, 2005

JON W. DUDAS
*Director of the United States Patent and Trademark Office*